United States Patent [19]

Simeth

[11] 4,149,461

[45] Apr. 17, 1979

[54] DEVICE FOR ELIMINATING EFFECT OF BEARING PLAY IN PRINTING PRESS CYLINDERS

[75] Inventor: Claus Simeth, Muhlheim am Main, Fed. Rep. of Germany

[73] Assignee: Roland Offsetmaschinenfabrik Faber & Schleicher AG., Fed. Rep. of Germany

[21] Appl. No.: 844,908

[22] Filed: Oct. 25, 1977

[30] Foreign Application Priority Data

Oct. 28, 1976 [DE] Fed. Rep. of Germany ..... 2649052

[51] Int. Cl.[2] ..... B41F 7/40; B41F 13/20

[52] U.S. Cl. ..... 101/216; 101/136; 101/141; 101/375; 101/415.1

[58] Field of Search ..... 101/216, 415.1, 378, 101/136–145

[56] References Cited

U.S. PATENT DOCUMENTS

| | | | |
|---|---|---|---|
| 472,206 | 4/1892 | Cottrell | 101/216 |
| 738,821 | 9/1903 | Lindner | 101/136 |
| 1,171,490 | 2/1916 | Wood | 101/216 |
| 1,217,524 | 2/1917 | Story | 101/415.1 |
| 1,338,347 | 4/1920 | Wood | 101/216 |
| 1,900,664 | 3/1933 | Pritchard | 101/415.1 |
| 2,293,886 | 8/1942 | Bruker | 101/216 |

FOREIGN PATENT DOCUMENTS

| | | | |
|---|---|---|---|
| 741626 | 11/1943 | Fed. Rep. of Germany | 101/216 |

*Primary Examiner*—Clyde I. Coughenour
*Attorney, Agent, or Firm*—Leydig, Voit, Osann, Mayer & Holt, Ltd.

[57] ABSTRACT

A lithographic printing press having the usual plate cylinder, blanket cylinder and impression cylinder in pressure engagement with one another, the bearings having at least a normal amount of play so that the journals are supported in normal elevated positions in the bearings depending upon the direction of the pressure vectors, at least the blanket and impression cylinders having phased gaps in the surfaces thereof, tending to cause cyclical, momentary loss of support accompanied by dropping of the blanket cylinder from the normal journal position in the bearing as the region of the gap is traversed, followed immediately by lifting of the blanket cylinder back to normal position resulting in cyclical impact. In order to prevent such dropping and lifting a cam is provided which extends coaxially about the bearing of the blanket cylinder on a line connecting the centers of the blanket and the impression cylinders, and a cam follower is rotationally secured to the blanket cylinder phased with the gap therein, the cam and cam follower serving to provide bridging support for the blanket cylinder during the time that the gap is being traversed, thereby to avoid cyclical impact. Where short, relatively thick stock is to be printed, the effective arcuate span of the cam and cam follower are increased to extend the bridging support over the non-printing area.

11 Claims, 16 Drawing Figures

DROP

DEVICE FOR ELIMINATING EFFECT OF BEARING PLAY IN PRINTING PRESS CYLINDERS

It is well known that the plate cylinder, blanket cylinder and impression cylinder in a lithographic printing press must operate in mutual pressure engagement. Assuming the presence of at least normal play in the bearings, the journals of the cylinders are supported in normal elevated running positions in the bearings depending upon the direction of the pressure vectors acting thereon. If the cylinder surfaces were complete and continuous, each journal would continue to occupy a fixed running position in the bearing, notwithstanding the existence of play. However, at least a portion of the cylinders, and normally all of them, have gaps, with traversal of the gaps resulting in a momentary loss of pressure support, accompanied by the dropping of one or more of the cylinders from normal position in its bearings and followed immediately by lifting back to normal position. This cyclical dropping and lifting which occurs during each revolution results in repeated impact, the severity of which depends upon the amount of bearing play, which produces streaks in the printed image. The interval of failure of support is lengthened when printing upon board stock having appreciable thickness and of short length taking up less than the maximum format.

In order to combat this problem both in lithographic presses and letter presses, it has been common to employ bearer rings. Use of such rings is however disadvantageous since only limited adjustment in printing pressure is possible. Another approach is to use multipiece bearings bushes which are clamped tightly together for constant take up of bearing play. German publication DT-PS No. 465 247 and DT-PS No. 1253 282 show structures designed to prevent a change in position of the cylinder while the machine is running. All of the prior attempts at solution have certain disadvantages or are not fully effective.

It is, accordingly, an object of the present invention to provide a structure for holding printing press cylinders in normal elevated running positions during the traverse of gaps in the surfaces thereof which is highly effective yet simple and economical. More specifically it is an object to provide means for maintaining printing press cylinders in predetermined positions with respect to one another regardless of the amount of play which may exist in the bearings of the individual cylinders.

It is a more specific object to provide, for a given one of the cylinders, a cam and cam follower phased for engagement thereby to provide bridging support for the cylinder during the time that the gap therein is being traversed to avoid the cyclical impact which results from the loss and reestablishment of support during gap traversal.

It is a related object to provide a cyclically engageable cam and cam follower providing bridging support for a printing press cylinder which is smooth in its operation, which has inherently long life and which may be operated for long periods of time without special maintenance or attention.

It is yet another object of the invention to provide, in association with a printing press cylinder, a cam and cam follower which not only provide support for the purpose of bridging of gaps in the surface thereof but the span of which is circumferentially extended beyond the region of the gap to provide auxiliary support over the non-printing area when printing sheets of short length. In this connection it is a particular object to provide means for defeating play in the cylinders of a printing press which is effective under the normally difficult situation where short lengths of cardboard stock must be printed and where there is a failure of cylinder supporting pressure, not only over the gap, but over the entire non-printing area of the cylinder.

Thus it is an object to provide means for defeating play in a printing press cylinder which may be universally employed in letter presses as well as lithographic presses to produce smooth operation of the press free of impact regardless of the amount of play which has developed in the bearings and which is universally applicable not only in new press designs but in the retrofitting of presses, including aged presses already in the field, making it possible for such presses to handle all thicknesses and sizes of sheets quietly and efficiently.

Other objects and advantages of the invention will become apparent upon reading the attached detailed description and upon reference to the drawings in which.

Figure 3:
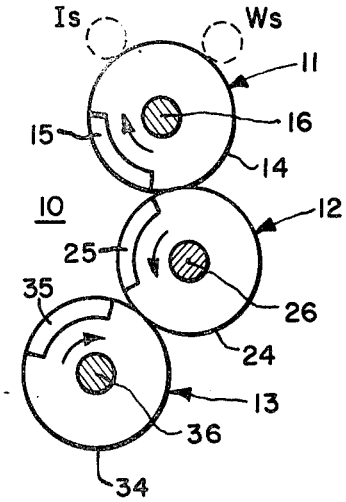
FIG. 3 (PRIOR ART)
FIGS. 3, 4 and 5 show a set of lithographic printing cylinders characteristic of the prior art under conditions of printing, gap traversal and resumption of printing, respectively.
Figure 3A:
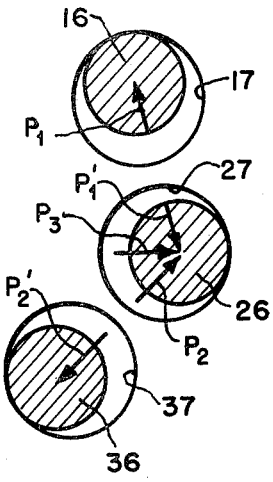
FIG. 3a (PRIOR ART)
Figure 6:
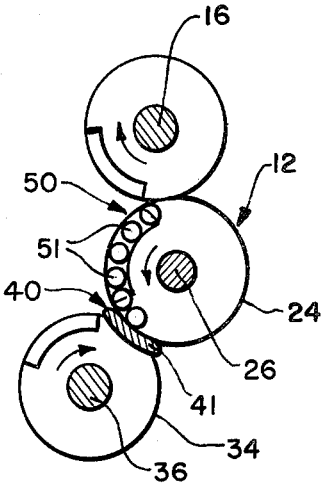
Figure 4:
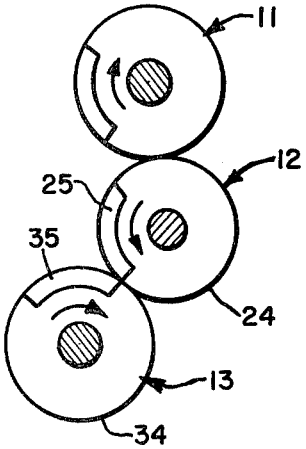
FIG. 4 (PRIOR ART)
Figure 7:
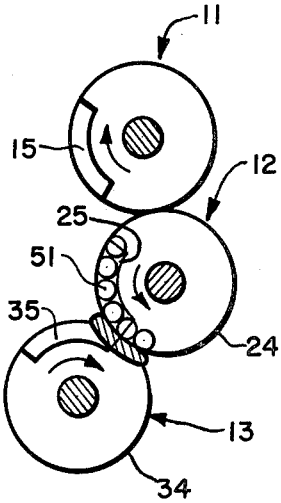
Figure 5:
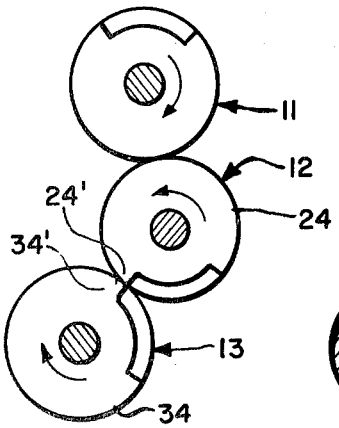
FIG. 5 (PRIOR ART)
Figure 8:
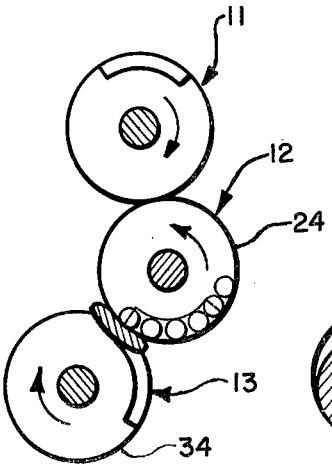

FIGS. 3*a*–5*a* show the positions of the journals in their bearings under the respective conditions of FIGS. 3–5, the positions being the same at each side of the press;

FIGS. 6, 7 and 8 are diagrams showing use of the cam and cam follower of the invention but which otherwise correspond to FIGS. 3–5;

FIGS. 6*a*–8*a* show maintenance of the journals in fixed positions in their respective bearings, notwithstanding the traversal of gaps and non-printing area.

Figure 1:
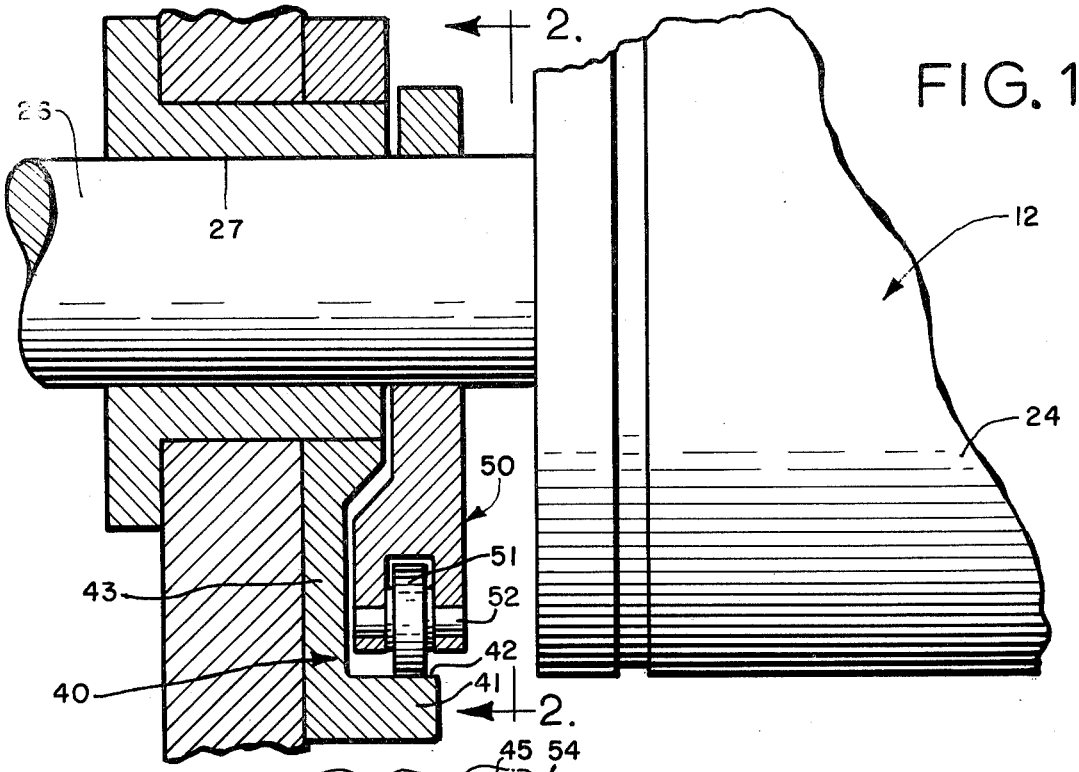
FIG. 1 is a fragmentary cross section taken longitudinally through the bearing supporting the blanket cylinder of a lithographic printing press and looking along the line 1—1 in FIG. 2.
Figure 2:
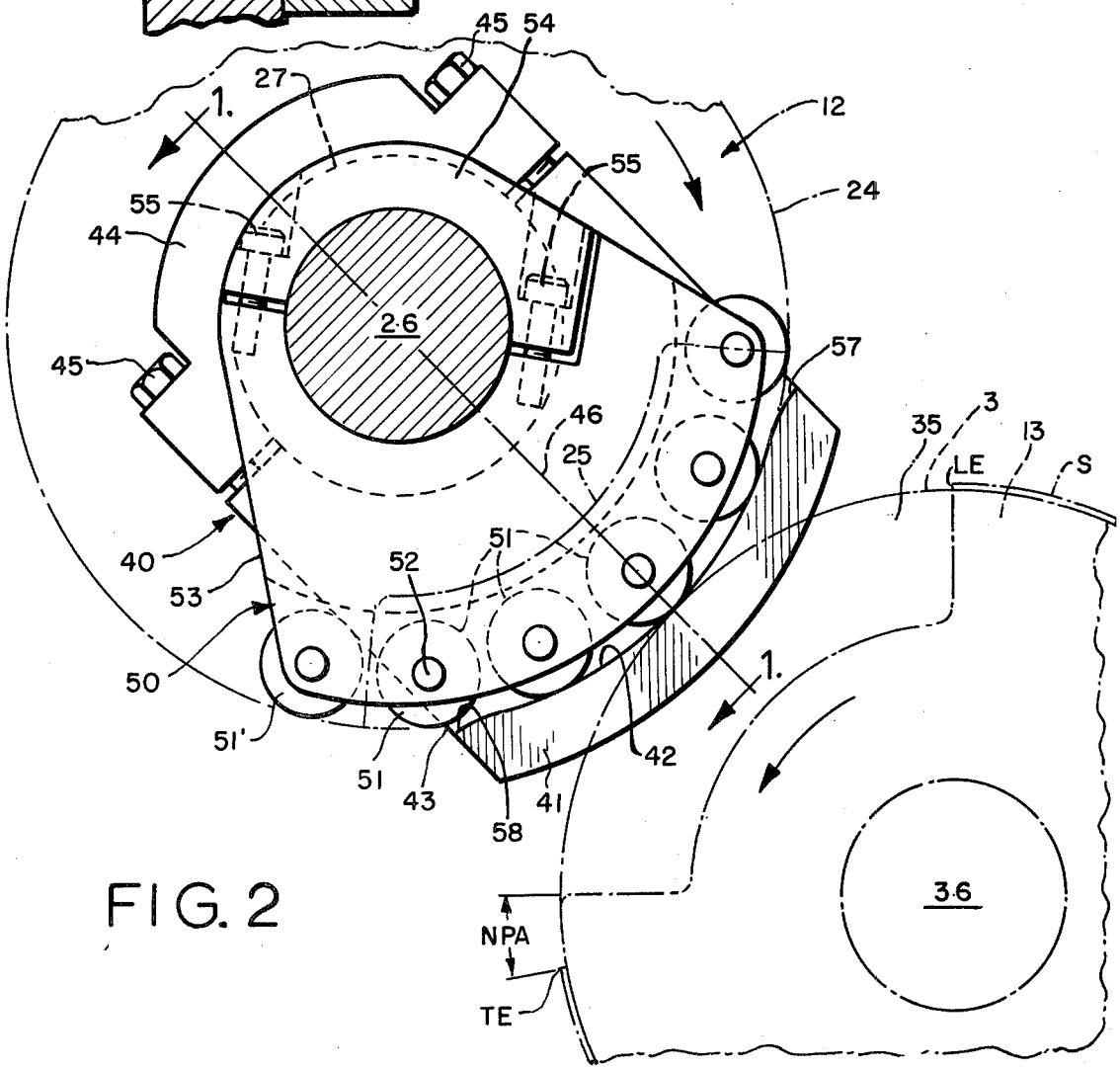
FIG. 2 is a transaxial view looking along line 2—2 in FIG. 1.
Figure 9:
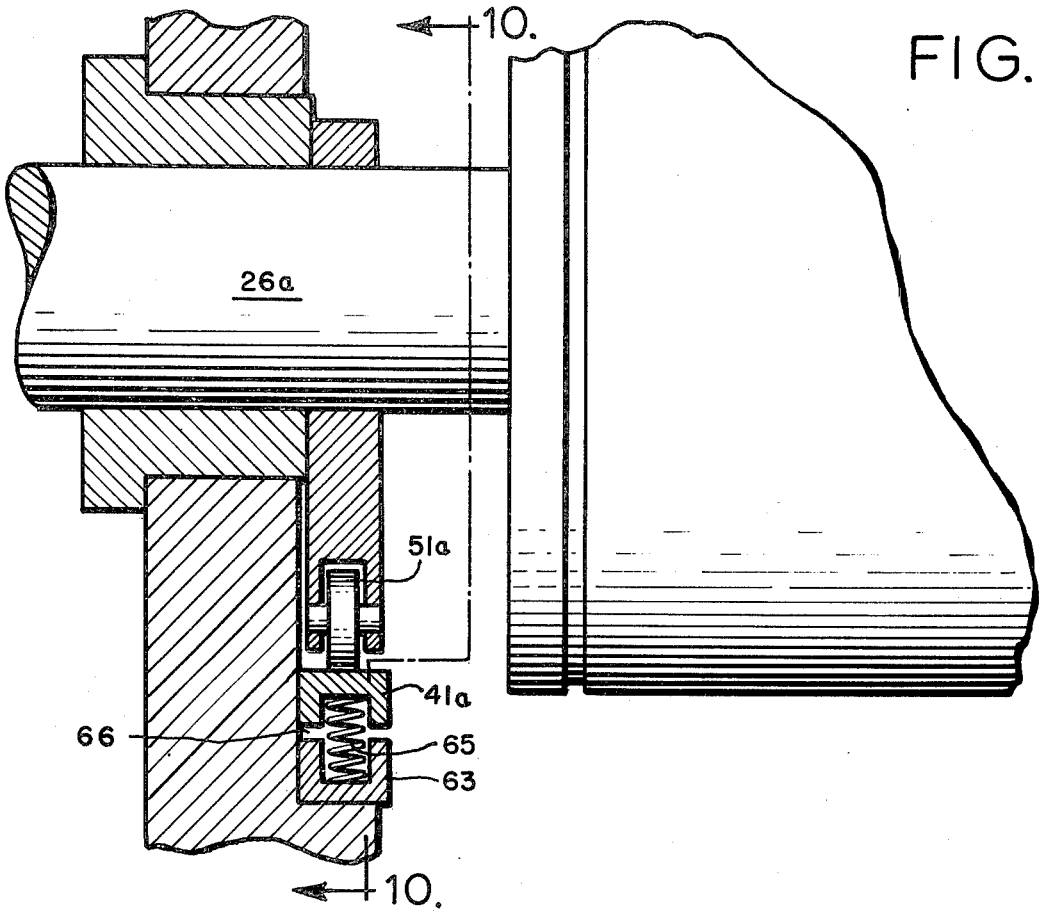
Figure 10:
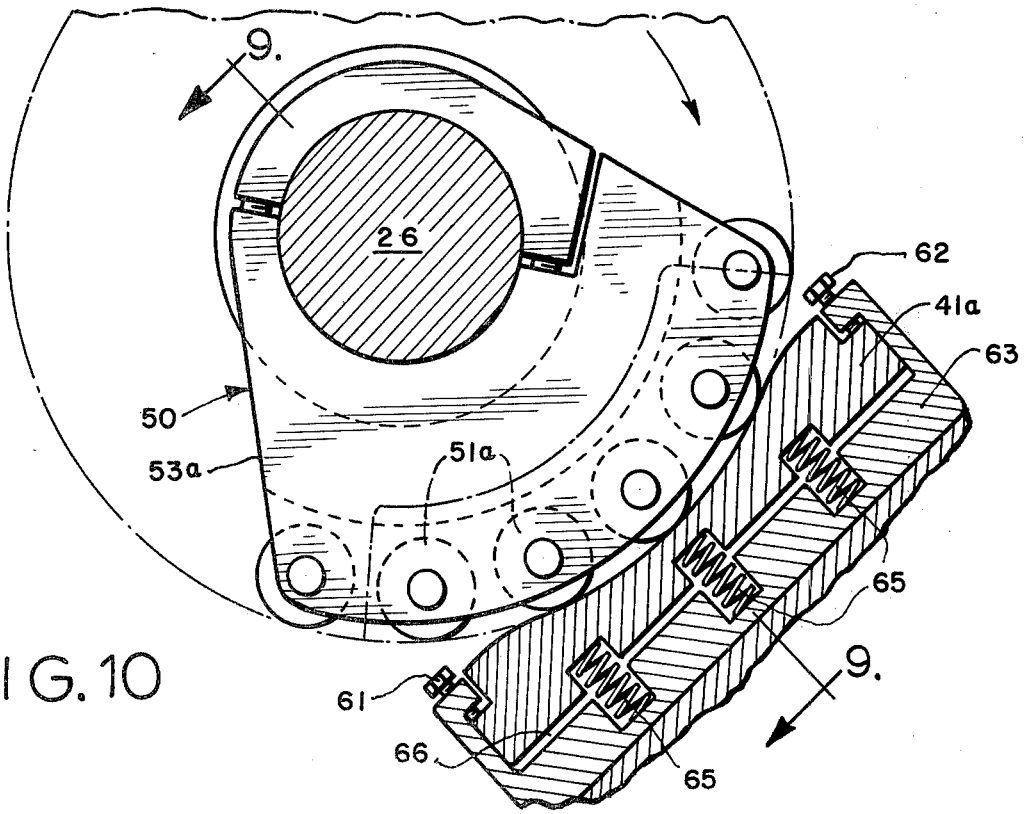

FIGS. 9 and 10 are views showing a cushioned version of the invention corresponding to that illustrated in FIGS. 1 and 2.

While the invention has been described in connection with certain preferred embodiments, it will be understood that I do not intend to be limited to the particular embodiments shown, but intend, on the contrary, to cover the various alternative and equivalent constructions included within the spirit and scope of the appended claims.

Turning now to FIG. 3 there is shown, in profile, a typical printing assembly 10 such as used in a lithographic printing press consisting of a plate cylinder 11, a blanket cylinder 12, and an impression cylinder 13. Cross-reference may be made to prior patents and publications for the typical constructions of such cylinders as well as the necessary supporting and cooperating structure including ink and water supply systems indicated generally at IS and WS. Thus it will be understood that the plate cylinder has an active cylindrical area 14 for the mounting of the printing plate and a groove or gap 15 in which the clamping or lock-up means for the plate is mounted, the lock-up being omitted for the sake of simplicity. It will be understood that the plate cylinder has a pair of journals 16, one of which is shown in FIG. 3*a*, and which rotates in the cylindrical bearing 17.

Similarly the blanket cylinder 12 has a cylindrical blanket area 24, a gap 25 and a journal 16, the journal 26 rotating in a bearing 27.

Finally, the impression cylinder 13, which carries the sheet to be printed, has an available sheet supporting area 34 interrupted by a gap 35, with the cylinder including a shaft or journal 36 rotatable in a bearing 37.

It will be understood that adjustable means, not shown, but commonly in the form of eccentric sleeves, are provided for shifting the positions of the bearings 17, 27 and 37 to place the cylinders in pressure engagement with one another as required for practical printing. The applied pressures and reaction pressures are indicated by the vectors in FIG. 3*a*. Thus the vector P1 represents the pressure exerted by the plate cylinder upon the blanket cylinder and the vector P1' represents the opposite reaction force. Similarly the vector P2 represents the vector of the pressure exerted by the impression cylinder against the blanket cylinder while the pressure P2' represents the force in the opposite direction. The combination of the vectors P1, P2, produces a resultant vector P3 which serves to hold the journal 26 of the blanket cylinder in a relatively elevated position within the limits of play existing in the bearing 27 which encloses it. It will be noted that because of the angling of the vector P2' to the left, the journal 36 is also supported in a slightly elevated running position within its bearing 37.

In short, FIG. 3*a* shows the manner in which play is normally taken up by reason of mutual cylinder pressure, with the journals of the cylinders shown in the positions which they occupy as long as the pressure condition between the cylinders, and represented by the vectors, exists.

Figure 4A:
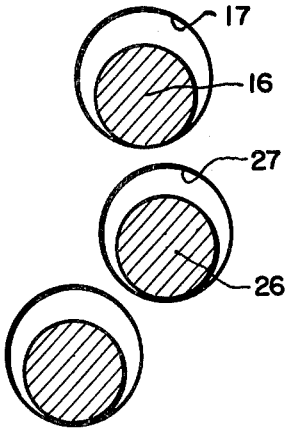
FIG. 4a (PRIOR ART)

Unfortunately the pressure condition does not persist over a full cylinder revolution. Thus FIG. 3 shows the condition of normal pressure, with the blankets and plate surfaces 24, 14 in contact and with the blanket and impression surfaces 24, 34 in contact. However shortly thereafter, as illustrated in FIG. 4, the phased gaps 25, 35 on the cylinders 24, 34, respectively, come into register, thereby substantially reducing, or even eliminating, the pressure vectors P2, P2'. Thus the blanket cylinder 12, which has been supported by the vector P2, is no longer supported, causing disappearance, as well, of the resultant pressure vector P3, so that the journal 26 of the blanket cylinder 12 is free to drop abruptly into its lowermost position in the bearing 21 as illustrated in FIG. 4*a*. The dropping of the blanket cylinder 12 results in loss of the force vector with the pressure vector P1', and its reaction force P1, permitting the plate cylinder 11 and its journal 16, also, to drop to the lowermost position within the associated bearing 17, as shown in the same figure. This dropping of the blanket cylinder 12, and the plate cylinder 11 along with it, produces a "leaving edge" streak in the printing image.

Figure 5A:
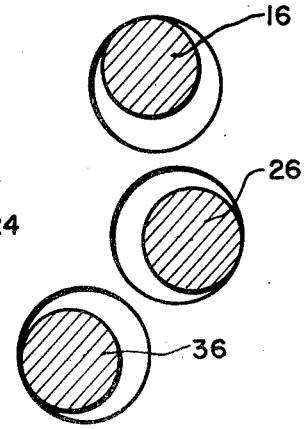
FIG. 5a (PRIOR ART)

Moreover a moment later, when the gap has been traversed and printing is resumed (FIG. 5), the leading edges 24', 34' of the surfaces 24, 34 on the blanket and impression cylinders come together with a forcible impact, restoring, or jacking up, the cylinders 11, 12 and their journals 16, 26 to their original elevated position, illustrated in FIG. 5*a*, reestablishing the original pressures existing between the cylinders and reestablishing the pattern of force vectors previously described. The second, or restoring, impact, which exceeds the first impact in magnitude, causes a "leading edge" streak on the printed product.

In accordance with the present invention, the blanket cylinder 12 is supported in its normal and desired running position, free from any cyclical shift of its journal, notwithstanding bearing play, by "bridging" of the period of traversal of the gap by use of a cam and cam follower. More specifically in accordance with the invention, a cam is provided which is fixed with respect to the frame and which has a surface extending coaxially about the blanket cylinder. Cooperating with the cam is a cam follower rotatably secured to the blanket cylinder, the cam being located on a line connecting the centers of the blanket and impression cylinders and the cam follower being phased with the gap in the blanket cylinder to provide bridging support for the blanket cylinder during the time the gap thereon is being traversed.

Thus referring to FIGS. 1 and 2, which show the blanket cylinder 12, its journal 26 and bearing 27, a cam assembly 40 is provided including an arcuate cam or bearer 41 having a cam surface 42 which is coaxially arranged with respect to the bearing 27, the cam 41 being supported upon an arm 43. The arm is supported in a desired phase position by means of a clamp 44 having clamping bolts 45, the clamp encircling, and tightly gripping, the outer surface of the bearing 27. In carrying out the invention the cam 41 is located upon a line 46 which, as shown, interconnects the center of the blanket cylinder 12 to the center of the impression cylinder 13. Further in accordance with the invention, a cam follower is provided rotatably secured to the blanket cylinder for cooperating with the cam 41. In the present instance the follower is in the form of a cam follower assembly 50 having a set of cam follower rollers 51 mounted upon pins 52 which are secured to a radial arm 53 having a clamping member 54 which, employing screws 55, serves to clamp the follower assembly 50 rigidly to the journal 26 for rotation therewith. The cam follower is, as shown, phased with the gap 25 in the blanket cylinder.

It may be noted that by reason of the clamps 44, 54 the cam 41 is rotationally adjustable with respect to the press frame and the phase of the cam follower assembly 50 is rotatably adjustable with respect to the cylinder 12 which supports it. Once these adjustments are made, wherever they may be left intact except for convenient removal as might be required for maintenance. Because of the simplicity of the structure, maintenance is, however, minimized.

It is one of the features of the construction that the cam 41 has a chamfered, or tapered, entryway surface 57 and a chamfered exiting surface 58 for guiding the rollers 51 onto the cam with minimum impact and for releasing the rollers smoothly and gradually from the cam surface.

The improvement brought about in the operation of the press by reason of the cam and cam follower will be apparent upon considering FIGS. 6–8 which show the three conditions corresponding to the earlier described FIGS. 3–5. It will be understood in FIGS. 6–8 that the same elements are present as in the earlier figures but with the addition of the cam assembly 40 and follower assembly 50 which are represented in FIGS. 6–8 by the cam surface 41 and rollers 51. The latter, may, for convenience, be considered as pinned directly to the end of the blanket cylinder 12, as far as support is concerned.

Thus, taking the condition shown in FIG. 6 which shows the surfaces 24, 34 in pressure contact, the same system of pressure vectors is established as shown in FIG. 3*a*, the journals 16, 26, 36 being supported, by the pressure vectors, in the normal running positions which have been illustrated.

A moment later the gaps 25, 35 on the cylinders 12, 13, respectively, come into coincidence as shown in FIG. 7. This might be expected to drop the journals into the condition previously discussed in FIG. 4*a*. However because of the position of the cam 41 and the phasing of the rollers 51 on the blanket cylinder, the rollers, and hence the blanket cylinder itself, are supported in a fixed position with respect to the press frame during the entire period of traversal of the gaps so that the pressure vector pattern and the position of the journals remains unchanged, as will be seen by comparing FIG. 7*a* with FIG. 6*a*. This eliminates any possibility of initial impact and therefore precludes streaking of the product.

Immediately thereafter (FIGS. 8, 8*a*), when printing resumes, surfaces 24, 34 are restored to engagement thereby maintaining the cylinders still supported in their elevated positions; meanwhile the trailing ones of the rollers 51 leave the cam surface 41, cam support no longer being required. Since there is no impact at the resumption of printing there is no need for resumption of journal position, thereby obviating the second of the two impacts and avoiding any "leading edge" streak in the printed product.

Figure 6A:
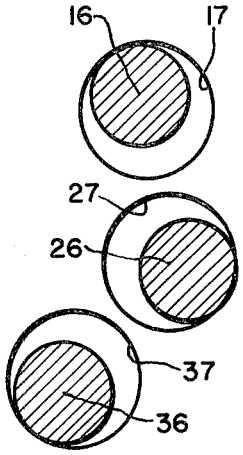
Figure 7A:
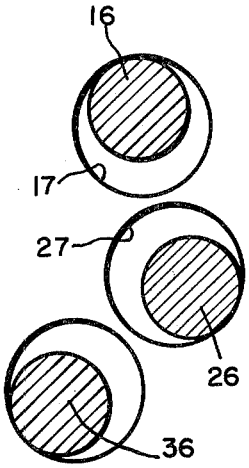
Figure 8A:
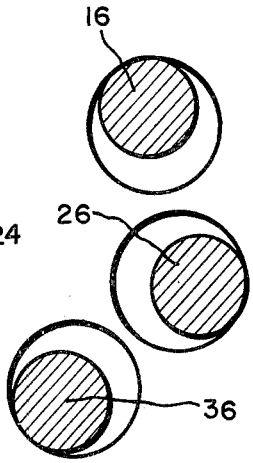

Thus it will be seen upon comparing FIGS. 6*a*, 7*a* and 8*a* that the journals, and the cylinders, occupy the same relative positions with respect to the bearings during an entire cycle, and during the course of repeated rotation, and this is true regardless of the amount of play which may exist in the bearings.

While the invention has been discussed in connection with the cam and cam follower associated with the blanket cylinder 12, it will be apparent that the invention is not limited thereto and an identical cam and cam follower may be employed with any of the cylinders in the series, the only requirements being that the cam be located on the line connecting the center of the associated cylinder with the center of the adjacent cylinder and that the cam follower be phased with respect to the gap in the cylinder upon which it is mounted.

Also in accordance with the present invention the duration of the cam support need not necessarily be limited to the duration of gap traversal. On the contrary, it is preferred to extend the duration of the support to extend over the non-printing area of the cylinder, particularly where a thick product, for example heavy paperboard, is being printed. This feature of the invention may be appreciated upon referring to FIG. 2 where it will be noted that the sheet S mounted upon the impression cylinder has a leading edge LE which coincides with the edge of the gap 35 but the sheet does not occupy the entire printing format of the cylinder, having a trailing edge TE which falls short of the opposite edge of the gap resulting in a non-printing area NPA. Where the sheet is of thick stock, the area NPA is non-supportive. Thus to provide support in the non-printing area NPA, the series of rollers 51 is extended, as, for example, by providing an end roller 51' in leading position which, by reasons of supportive engagement by the cam 41, provides support for the cylinder 12 outside of the region of gap traversal. Where a press is employed for the printing of full format on a consistent basis, the auxiliary roller 51' may, if desired, be omitted. On the other hand where it is the practice to print a short product consistently the series of rollers may be further extended or the cam itself may be elongated in a direction to increase the arcuate span to insure support over the non-printing area.

In the preferred form of the invention rollers 51 are provided on the cam follower assembly for anti-friction purposes. It will be understood by one skilled in the art, wherever, that the rollers may be interchanged in position; that is, the rollers 51 may be omitted from the follower assembly 50 and used instead on the cam assembly 40, for example, with the peripheries of the rollers extending upwardly from the surface 42 into engagement with the peripheral edge of the arm 53 of the follower assembly.

In accordance with one of the more detailed features of the present invention, the cam 41 is preferably set in working position by adjustable radial stops, with spring means being provided for pressing the cam into bottoming engagement with the stops, while permitting a limited degree of retreating movement for cushioned engagement of the cam by the cam follower rollers. This is shown in FIGS. 9 and 10 in which elements corresponding to the elements of the earlier embodiment are given the same reference numerals with the addition of subscript a.

Thus the cam, indicated at 41*a*, and which is engaged by the rollers 51*a*, is located in running position by radially oriented adjustable stops 61, 62 which are preferably in the form of the screws threadedly engaged in the bracket or cradle 63 which is fixed with respect to the press frame. Interposed between the cradle 63 and the cam 41*a* are a series of compression springs 65 which act to keep the stops normally bottomed; however, clearance 66 is provided between the cam and the cradle to accommodate a limited degree of retreating movement. Consequently the initial, and successive, engagement of the rollers 51*a* with the cam surface is cushioned, taking place silently with minimum impact or wear.

While the invention has been described as particularly applicable to support of the blanket cylinder during traversal of the gap and non-printing area, it will be understood that the invention is not limited thereto and similar auxiliary supporting means may be employed on any cylinder having a gap, or which is subject to the effect of a gap, on a companion cylinder. The cylinder selected for the auxiliary support depends upon the orientation of the series of cylinders, that is to say which cylinder, or cylinders, are most affected by gravity in the unsupported condition; in the present instance it is apparent that the blanket cylinder is the logical choice since the journal 26 thereof is subject to substantial shift and since the cylinder serves, also, to support the plate cylinder which is above it.

By the term "effective arcuate span" of the cam and cam follower is meant the arc over which the two, acting together, provide auxiliary support. While rollers, in the form of rotatable discs, are preferred as an anti-friction means the term "rollers" is not limited thereto and includes other, equivalent, anti-friction means such as captively held balls on either the cam or follower side.

What I claim is:

1. In a lithographic printing press, the combination comprising a frame, a serially arranged set of cylinders including a plate cylinder, blanket cylinder and an impression cylinder, the cylinders being in mutual pressure engagement and all of the cylinders having journals turning in bearings in the frame, the bearings having normal play so that the journals are supported by the mutual pressure in normal elevated positions in the bearings depending upon the direction of the pressure vectors respectively acting thereon, the blanket and impression cylinders having phased peripheral gaps in the surfaces thereof tending to cause a cyclical momentary loss of support accompanied by dropping of the blanket cylinder from its normal position in its bearing followed immediately by lifting back of the blanket cylinder to normal position with resultant impact as the gap is traversed, the improvement which comprises a cam substantially fixed with respect to the frame and presenting a bearing surface which extends coaxially through a limited arc about the blanket cylinder and a cam follower rotatively secured to the blanket cylinder for cooperating with the cam, the cam being located on a line connecting the centers of the blanket and impression cylinders and the cam follower being phased with the gap in the blanket cylinder, the cam and cam follower having an effective arcuate span which is sufficient to provide bridging support for the blanket cylinder during the time the gap thereon is being traversed thereby to avoid the cyclical impact which results from cyclical loss of support.

2. The combination as claimed in claim 1 in which the effective arcuate span of the cam and cam follower exceeds the peripheral width of the gap thereby to provide bridging support for the blanket cylinder where thick sheets are printed having a length which falls short of the total printing format resulting in failure of normal support in the non-printing area.

3. In a lithographic printing press the combination comprising a frame, a serially arranged set of cylinders including a plate cylinder, blanket cylinder and impression cylinder, the cylinders being in mutual pressure engagement and all of the cylinders having journals turning in bearings in the frame, the bearings having at least normal play so that the journals are supported by the mutual pressure in normally elevated positions in the bearings depending upon the direction of the pressure vectors respectively acting thereon, at least one of the cylinders having a peripheral gap in the surface thereof tending to cause a cyclical momentary loss of support accompanied by dropping of the one cylinder from its normal position in its bearing followed immediately by lifting back to normal position with resultant impact as the gap is traversed, the improvement which comprises a cam substantially fixed with respect to the frame and presenting a bearing surface which extends coaxially through a limited arc about the one cylinder, and a cam follower rotationally secured to the one cylinder for cooperating with the cam, the cam being located on a line connecting the center of the one cylinder with the adjacent cylinder, the cam follower being phased with the gap in the one cylinder to provide bridging support for such cylinder during the time that the gap is being traversed thereby to avoid the cyclical impact which results from cyclical loss of support.

4. The combination as claimed in claim 3 in which the cam is of arcuate shape and chamfered at its ends for progressive engagement and progressive disengagement of the cam follower.

5. The combination as claimed in claim 3 in which rollers are interposed between the cam and cam follower for antifriction purposes.

6. The combination as claimed in claim 5 in which springs are interposed effectively in series with the cam and cam follower for cushioning the engagement of the rollers.

7. The combination as claimed in claim 3 in which the cam is rotationally adjustable with respect to the center of the bearing supporting the associated cylinder.

8. The combination as claimed in claim 3 in which the cam is supported on an arm having means for clamping the same coaxially in fixed angular position to the bearing supporting the associated cylinder.

9. The combination as claimed in claim 3 in which the cam follower is in the form of an arm secured to the shaft of the one cylinder, the arm providing an effective arcuate span at least equal to the arcuate span of the gap, the arm having a set of idler rollers, distributed over the arcuate span.

10. In a lithographic printing press the combination comprising a frame, a serially arranged set of cylinders including a plate cylinder, blanket cylinder and impression cylinder, the cylinders being in mutual pressure engagement and all of the cylinders having journals turning in bearings in the frame, the bearings having at least normal play so that the journals are supported by the mutual pressure in normally elevated positions in the bearings depending upon the direction of the pressure vectors respectively acting thereon, at least one of the cylinders having a gap in the surface thereof tending to cause a cyclical momentary loss of support accompanied by dropping of the one cylinder in its bearing followed immediately by lifting back to normal position with resulting impact as the gap is traversed, the improvement which comprises a cam substantially fixed in working position on the frame and presenting a bearing surface which extends coaxially through a limited arc about the one cylinder, and a cam follower rotationally secured to the one cylinder for cooperating with the cam, the cam being located on a line connecting the center of the one cylinder with the adjacent cylinder, the cam follower being phased with respect to the gap in the one cylinder to provide bridging support for the cylinder during the time that the gap is being traversed thereby to avoid the cyclical impact which results from cyclical loss of support, the cam being located in working position by adjusted radial stops, and spring means for pressing the cam into bottoming engagement with the stops while permitting a limited degree of retreating movement for cushioned engagement of the cam by the cam follower.

11. In a printing press the combination comprising a frame, a set of cylinders including a plate cylinder and impression cylinder, the cylinders being in mutual pressure engagement and having journals turning in bearings in the frame, the bearings having at least normal play so that the journals of at least one of the cylinders are supported by the pressure in a normally elevated running position in the bearings, at least the one cylinder having a peripheral gap in the surface thereof tending to cause a cyclical momentary loss of support accompanied by dropping of the one cylinder in its bearing followed immediately by lifting back to normal position as the gap is traversed, the improvement which comprises a cam substantially fixed with respect to the frame and having a bearing surface extending coaxially through a limited arc about the one cylinder, and a cam follower rotationally secured to the one cylinder for cooperating with the cam, antifriction means being interposed between the cam and cam follower, the cam being located on a line connecting the center of the one cylinder with the adjacent cylinder and the cam follower being phased with the gap in the one cylinder to provide bridging support for such cylinder during the time that the gap is being traversed thereby to avoid the cyclical impact which results from the cyclical loss of support.

* * * * *